US006376456B1

(12) United States Patent
Murphy et al.

(10) Patent No.: US 6,376,456 B1
(45) Date of Patent: Apr. 23, 2002

(54) WRINKLE REDUCTION LAUNDRY PRODUCT COMPOSITIONS

(75) Inventors: Dennis Stephen Murphy, Leonia; Daniel Joseph Fox, Tenafly; Francoise Meyer, Hackensack, all of NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/293,323

(22) Filed: Apr. 16, 1999

Related U.S. Application Data

(60) Provisional application No. 60/105,887, filed on Oct. 27, 1998.

(51) Int. Cl.[7] ..... C11D 3/00; C11D 3/37; C11D 1/28; C11D 1/82; C11D 17/04

(52) U.S. Cl. ..... 510/516; 252/8.63; 252/8.91; 510/466; 510/475; 510/492; 510/513; 510/515; 510/521; 510/522; 510/527

(58) Field of Search ..... 510/513, 515, 510/516, 521, 522, 527, 466, 475, 492; 252/8.63, 8.91

(56) References Cited

U.S. PATENT DOCUMENTS

| | | | | | |
|---|---|---|---|---|---|
| 3,619,115 | A | | 11/1971 | Diehl et al. | 8/137 |
| 3,674,688 | A | * | 7/1972 | Schwartz et al. | 252/8.91 |
| 3,861,870 | A | * | 1/1975 | Edwards et al. | 510/516 |
| 3,864,475 | A | | 2/1975 | Willard, Sr. | 424/70 |
| 3,874,927 | A | | 4/1975 | Willard, Sr. | 134/25 A |
| 3,915,738 | A | | 10/1975 | Willard, Sr. | 134/2 |
| 3,931,031 | A | | 1/1976 | Willard, Sr. | 252/99 |
| 3,992,332 | A | | 11/1976 | Zenon | 252/548 |
| 4,076,633 | A | * | 2/1978 | Edwards et al. | 510/516 |
| 4,237,155 | A | | 12/1980 | Kardouche | 427/242 |
| 4,238,531 | A | | 12/1980 | Rudy et al. | 427/242 |
| 4,261,868 | A | | 4/1981 | Hora et al. | 252/529 |
| 4,322,308 | A | | 3/1982 | Hooper et al. | 252/107 |
| 4,327,133 | A | | 4/1982 | Rudy et al. | 427/242 |
| 4,400,288 | A | | 8/1983 | Dhanani et al. | 252/135 |
| 4,421,792 | A | | 12/1983 | Rudy et al. | 427/242 |
| 4,639,321 | A | | 1/1987 | Barrat et al. | 252/8.8 |
| 4,652,392 | A | | 3/1987 | Baginski et al. | 252/109 |
| 4,661,268 | A | * | 4/1987 | Jacobson et al. | 252/8.91 |
| 4,698,178 | A | | 10/1987 | Huttinger et al. | 252/309 |
| 4,784,799 | A | | 11/1988 | Petroff | 252/545 |
| 4,800,026 | A | * | 1/1989 | Coffindaffer et al. | 510/516 |
| 4,806,254 | A | * | 2/1989 | Church | 510/513 |
| 4,846,982 | A | | 7/1989 | Madore et al. | 252/8.75 |
| 4,911,852 | A | | 3/1990 | Coffindaffer et al. | 252/8.8 |
| 4,959,179 | A | | 9/1990 | Aronson et al. | 252/135 |
| 4,978,471 | A | | 12/1990 | Starch | 252/174.15 |
| 5,064,544 | A | | 11/1991 | Lin et al. | 556/424 |
| 5,089,163 | A | | 2/1992 | Aronson et al. | 252/135 |
| 5,094,761 | A | | 3/1992 | Trinh et al. | 252/8.9 |
| RE34,062 | E | | 9/1992 | Wells | 8/137 |
| 5,147,576 | A | | 9/1992 | Montague et al. | 252/174 |
| 5,171,476 | A | | 12/1992 | Bloodworth et al. | 252/314 |
| 5,205,957 | A | | 4/1993 | Van de Pas | 252/173 |
| 5,234,610 | A | | 8/1993 | Gardlik et al. | 252/8.6 |
| 5,271,868 | A | | 12/1993 | Azechi et al. | 252/358 |
| 5,288,417 | A | | 2/1994 | Bauer et al. | 252/8.8 |
| 5,348,667 | A | | 9/1994 | Bacon et al. | 252/8.6 |
| 5,360,571 | A | | 11/1994 | Kilgour et al. | 252/174.15 |
| 5,376,287 | A | | 12/1994 | Borcher, Sr. et al. | 252/8.8 |
| 5,403,499 | A | | 4/1995 | Kiefer et al. | 252/8.6 |
| 5,411,671 | A | | 5/1995 | Bauer et al. | 252/8.8 |
| 5,441,667 | A | | 8/1995 | Tonomura et al. | 252/174.15 |
| 5,449,609 | A | | 9/1995 | Younkin et al. | 437/7.21 |
| 5,460,736 | A | | 10/1995 | Trinh et al. | 252/8.8 |
| 5,532,023 | A | * | 7/1996 | Vogel et al. | 427/8 |
| 5,545,350 | A | | 8/1996 | Baker et al. | 510/517 |
| 5,562,849 | A | | 10/1996 | Wahl et al. | 510/521 |
| 5,573,695 | A | * | 11/1996 | Targosz | 252/8.91 |
| 5,645,751 | A | | 7/1997 | Haley | 252/8.91 |
| 5,648,327 | A | | 7/1997 | Smerznak et al. | 510/340 |
| 5,681,355 | A | | 10/1997 | Davis et al. | 8/137 |
| 5,686,404 | A | | 11/1997 | Jeuniaux | 510/466 |
| 5,714,453 | A | | 2/1998 | Neumiller | 510/405 |
| 5,731,278 | A | | 3/1998 | Nair et al. | 510/320 |
| 5,741,760 | A | | 4/1998 | Mondin et al. | 510/365 |
| 5,759,208 | A | | 6/1998 | Zhen et al. | 8/137 |
| 5,759,983 | A | | 6/1998 | Mondin et al. | 510/365 |
| 5,762,647 | A | | 6/1998 | Brown et al. | 8/137 |
| 5,789,373 | A | * | 8/1998 | Baker et al. | 510/522 |
| 5,798,107 | A | * | 8/1998 | Vogel et al. | 424/400 |
| 5,804,544 | A | | 9/1998 | Powell et al. | 510/347 |
| 5,830,843 | A | * | 11/1998 | Hartman et al. | 510/475 |

FOREIGN PATENT DOCUMENTS

| | | | |
|---|---|---|---|
| EP | 0 242 919 | 10/1987 | C11D/3/00 |
| EP | 0 255 711 A2 | 2/1988 | |
| EP | 0 363 346 | 4/1990 | C11D/3/37 |
| EP | 0 544 493 A1 | 6/1993 | |
| WO | 94/07980 | 4/1994 | |
| WO | 96/34092 | 10/1996 | C12N/9/42 |
| WO | 97/32917 | 9/1997 | |
| WO | 98/56890 | 12/1998 | |

OTHER PUBLICATIONS

Chemical Abstract No. 77:128004, abstract of South African Patent Specification No. 7005365 (Feb.1972).*

Partial International Search Report PCT/EP 99/08320 dated Feb. 29, 2000.

Database WPI, Derwent Publications Ltd., XP002128906 (Jul. 30, 1984).

* cited by examiner

*Primary Examiner*—Anthony Green
(74) *Attorney, Agent, or Firm*—Edward A. Squillante, Jr.

(57) ABSTRACT

The present application relates to the inclusion of one or more wrinkle reducing ingredients in a laundry fabric softening product. The benefits are delivered to the laundered item either during the rinse step of the washing procedure or in the dryer. The need for further wrinkle reducing steps when the items are taken from the dryer or after hang drying are thereby reduced.

5 Claims, No Drawings

WRINKLE REDUCTION LAUNDRY PRODUCT COMPOSITIONS

RELATED APPLICATIONS

This applications claims priority to Provisional application Ser. No. 60/105,887 filed Oct. 27, 1998.

BACKGROUND

When textiles, such as clothing, linens and the like, are laundered, it is typically desired that wrinkles be eliminated or minimized after the cleaning and drying process. Mechanical wrinkle reduction techniques, such as heat and pressure (for example, ironing), have been used but can be time consuming and inconvenient.

Known attempts to reduce wrinkles by means of chemical ingredients in the wash include the use of zwitterionic surfactants, amnosilicones, curable aminosilicones, cellulase enzymes and alkyl amides. However, each of these ingredients have one or more drawbacks. For example, zwitterionic surfactants are believed to work best in cold water. Aminosilicones can cause yellowing and can be difficult to formulate. Curable aminosilicones require the heat of an iron to reduce wrinkles. Cellulase enzymes generally require several wash cycles before anti-wrinkle benefits become noticeable. Alkyl amides are not very effective relative to other wrinkle reducing agents.

Liquid fabric softeners have been sold commercially since the late 1950's. They are preferably formulated to provide softening and fragrance benefits to fabrics (primarily cottons and cotton blends) when used in the rinse cycle of a washing machine. Liquid fabric softeners are generally formulated by making an aqueous dispersion of one or more cationic surfactants in water. The cationic surfactants are typically quarternized organonitrogen compounds that contain one or more, preferably two, long carbon chains attached to one or more nitrogen atoms. This material provides the primary softening benefit by depositing from the rinse solution onto the fabrics. Additional materials typically used in these formulations include preservatives, pH control agents, viscosity modifying salts, perfumes, optical brighteners, colorants and color care agents.

By purchasing and using liquid fabric softeners, the consumer is clearly interested in achieving fabric care benefits over and above those provided by known laundry detergents. Because wrinkles are generally undesirable, a liquid fabric softener that also decreases or eliminates wrinkles would be a welcomed additional benefit.

Therefore, there is a need and perceived benefit for an effective and efficient means for eliminating or reducing wrinkles in textiles. To be effective and efficient, the ingredient should preferably work across a broad range of water temperatures, not require the use of an iron, have little to no discoloration effect on the laundered item and/or provide a noticeable wrinkle reducing benefit after relatively few wash cycles.

Consumer products are also available that deliver softening and static control benefits in the dryer. Typically, these are in the form of fabric dryer sheets and are available under the tradenames Snuggle (Unilever) and Downy (Procter & Gamble). While these products deliver desired benefits, additional benefits, such as wrinkle reduction would also be desirable.

Therefore, there is also a need for wrinkle reducing agents that can deliver such benefits from dryer sheets.

SUMMARY

The present application relates to the inclusion of one or more wrinkle reducing ingredients in a liquid fabric softening product. The benefits are delivered to the laundered item during the rinse step of the laundry cycle (when the fabric softener is typically added) and, therefore, reduces the need for further wrinkle reducing steps when the items are taken from the dryer or after hang drying. The present application also relates to the inclusion of one or more wrinkle reducing ingredients in dryer sheets.

The ingredients that facilitate the benefit of wrinkle reduction are believed to lubricate fiber surfaces. By lubricating the fiber surfaces of garments, for example, the fibers slide more easily relative to each other and are less likely to entangle, resulting in less wrinkles. The preferred fiber lubricants disclosed herein have been shown to noticeably reduce the number of wrinkles. The preferred embodiments also overcome one or more of the above noted disadvantages of prior wrinkle reducing agents or methods.

DETAILED DESCRIPTION OF PREFERRED EMBODIMENTS

LIQUID FABRIC SOFTENER FORMULATIONS

Several molecules have been identified for wrinkle reduction benefits when included in known liquid fabric softener formulations. Using the American Association of Textile Chemists and Colorists (AATCC) method #124 (described in greater detail, below), the following molecular classes were found to reduce the number of wrinkles on test cloths: ethoxylated organosilicones; polyalkyleneoxide modified polydimethylsiloxane: linear aminopolydimethylsiloxane polyalkyleneoxide copolymers; sulfated/sulfonated vegetable oils; high molecular weight polyacrylamides; betaine siloxane copolymers: and alkylactam siloxane coplymers. Of the foregoing, the most preferred wrinkle reducing agent is a linear aminopolydimethylsiloxane polyalkyleneoxide copolymer sold under the name Magnasoft SRS, available from Witco, Greenwich, Conn. Silsoft A-843, another aminopolydimethylsiloxane polyalkyleneoxide copolymer available from Witco, is also a particularly preferred wrinkle reducing agent. Another preferred class of wrinkle reduction compounds are sulfated castor oils sold, for example, under the tradename Freedom SCO-75, available from Freedom chemical Co., Charlotte, N.C.

One or more of the molecules/compounds from the above-identified classes are preferably included in known fabric softener formulations in an amount from about 0.1 to about 10 wt %, about 0.1 wt % to about 5 wt %, about 0.3 to about 1.5 wt % and, most preferably, from about 0.3 wt % to about 5 wt %. Suitable liquid fabric softener formulations are described, for example. in U.S. Pat. Nos.: RE 34,062 (Wells); U.S. Pat. No. 5,288,417 (Bauer et al.); U.S. Pat. No. 5,403,499 (Kiefer et al.); U.S. Pat. No. 5,411,671 (Bauer et al); U.S. Pat. No. 5,460,736 (Trinh et al.); U.S. Pat. No. 5,545,350 (Baker et al.); and U.S. Pat. No. 5,562,849 (Wahl et al.), all of which are incorporated herein by reference. Should read: Such suitable formulations include 8% to 80% of a cationic fabric conditioning agent.

An additional advantage of the above-identified wrinkle reducing ingredients is that the molecules/compounds do not have a net positive charge in a neutral or alkaline medium, i.e. a medium having a pH greater than or equal to about 6.5. Lack of a net positive charge reduces the likelihood that precipitates will result when the above-identified wrinkle reducing ingredients come in contact liquid detergents containing anionic surfactants, such as in the rinse cycle of the laundering process. More specifically, they are less likely to precipitate with negatively charged surfactants.

TEST METHOD AND EXAMPLES

A preferred method of measuring wrinkle reduction is by using the American Association of Textile Chemists and Colorists' (AATCC) method #124, Appearance of Fabrics after Repeated Home Laundering. In this method four cloth types (silk. rayon, cotton, and linen) are washed, dried and stored in a well defined way. The dried cloths are then evaluated for wrinkle content by comparison with wrinkle smoothness replicas which can be purchased from AATCC. Factors such as the light used, the angle of the cloths and replicas to the light, and the background are carefully controlled and described in the method. There are six replicas with values of 1, 2, 3, 3.5, 4, and 5 with 5 being perfectly smooth and 1 being very wrinkled. Three trained observers are asked to give a value of 1–5, to the nearest 0.5 unit, to each cloth based on which replica it most closely resembles. The results are totaled and averaged over the three observers for each cloth type. According to the method, a difference of >0.7 between the results for two products indicates there is a significant difference at the 95% confidence level. A difference of greater than or equal to 0.25 indicates a significant difference at the 99% confidence level.

EXAMPLE 1

The following formulation containing a wrinkle reduction ingredient was produced:

Formulation 1

| Ingredient | Percent in Formula (by weight) |
|---|---|
| Ditallow dimethyl ammonium chloride (Arquad 2HT) | 6.5 |
| Amido amine ethoxylates (Accosoft 460) | 17.7 |
| Lactic acid | 0.22 |
| Glutaraldehyde | 0.07 |
| Fragrance | 0.7 |
| Calcium chloride | 0.2 |
| Magnasoft SRS* | 0.5 |
| Colorants | (ppm) |
| Water | to 100% |

*Wrinkle reduction agent - a linear aminopolydimethylsiloxane polyalkyleneoxide copolymer from Witco Chemical Co.

Formulation 2: The same as formulation 1 without the wrinkle reduction agent present.

Laboratory tests have shown wrinkle reduction benefits for Formulation 1 are greater than that of Formulation 2.

Wrinkle Test Results

Using the AATCC fabric smoothness test method as described above, several fabric types were laundered using either formulation 1 with Magnasoft SRS at 0.5% or the same formulation without any wrinkle reduction additive (Formulation 2). Results of the testing after four laundering cycles show wrinkle reduction benefits with use of Magnasoft SRS(Formulation 1) on rayon, silk, linen and 100% cotton. The results are significant at the 95% confidence level.

Fabric Smoothness Scores

| | Silk | Rayon | Linen | Cotton |
|---|---|---|---|---|
| Form. 1 | 3.28 | 2.11 | 2.72 | 2.20 |
| Form. 2 | 3.00 | 1.78 | 2.28 | 1.89 |

The following are other preferred formulations containing at least one wrinkle reducing agent:

Formulation 3

| Ingredient | Percent in Formula (by weight) |
|---|---|
| Ditallow dimethyl ammonium chloride (Arquad 2HT) | 6.5 |
| Amido amine ethoxylates (Accosoft 460) | 17.7 |
| Lactic acid | 0.22 |
| Glutaraldehyde | 0.07 |
| Fragrance | 0.7 |
| Calcium chloride | 0.2 |
| Magnasoft SRS* | 3.0 |
| Colorants | (ppm) |
| Water | to 100% |

*Wrinkle reduction agent - a linear aminopolydimethylsiloxane polyalkyleneoxide copolymer from Witco Chemical Co.

Formulation 4

| Ingredient | Percent in Formula (by weight) |
|---|---|
| Ditallow dimethyl ammonium chloride (Arquad 2HT) | 6.5 |
| Amido amine ethoxylates (Accosoft 460) | 17.7 |
| Lactic acid | 0.22 |
| Glutaraldehyde | 0.07 |
| Fragrance | 0.7 |
| Calcium chloride | 0.2 |
| Freedom SCO-75* | 1.0% |
| Colorants | (ppm) |
| Water | to 100% |

*Wrinkle reduction agent - a sulfated castor oil from Freedom Chemical Company.

Formulation 5

| Ingredient | Percent in Formula (by weight) |
|---|---|
| Ditallow dimethyl ammonium chloride (Arquad 2HT) | 6.5 |
| Amido amine ethoxylates (Accosoft 460) | 17.7 |
| Lactic acid | 0.22 |
| Glutaraldehyde | 0.07 |
| Fragrance | 0.7 |
| Calcium chloride | 0.2 |
| Freedom SCO-75* | 4.0% |
| Colorants | (ppm) |
| Water | to 100% |

*Wrinkle reduction agent - a sulfated castor oil from Freedom Chemical Company.

Preferred Method of Formula Preparation

The above cited formulas were prepared as follows: The quaternary fabric softener actives were mixed together under moderate agitation and heated to 160 degrees F. The water and some minor ingredients (colorants and preservatives) were combined in a second mixing vessel and were also heated to 160 degrees F. The two mixes were then combined by addition of the actives premix to the main batch under vigorous agitation. Viscosity control salts were added to the mixture in several increments while the batch was cooled to 100 degrees F. The fragrance and the wrinkle reduction compounds were then added under moderate agitation and the batch was further cooled to room temperature. The resultant product was uniform and free flowing and remained stable and pourable over time.

DRYER SHEETS

Dryer sheets are well known in the art. They generally include a substrate, upon which active ingredients are disposed. The dryer sheet is typically added to a hot air dryer with wet clothing after a laundering cycle. The present disclosure relates to the addition of one or more wrinkle reducing agents to known dryer sheet formulations. The wrinkle reducing agents can be added from about 0.1 wt % to about 25 wt %. Higher wt % levels of winkle reducing agents for dryer applications are desirable because it typically takes higher wt % levels of active ingredients in the dryer, such as with dryer sheets, to deliver the benefits to the same weight of fabrics as compared to a rinse conditioner. In use the dryer sheet is preferably added to a hot air clothes dryer with damp clothing. The sheet is allowed to come in contact with the clothing during the drying cycle. During this contact ingredients disposed on the dryer sheet, such as the wrinkle reducing agents, are transferred to the clothing.

The following example presents a formulation having 10 wt % wrinkle reducing agent for a dryer sheet:

Formulation 6

| Ingredient | Percent in Formula (by weight) |
|---|---|
| Free Fatty Acid | 46.8 |
| Wrinkle reducing agent | 10 |
| Nonionic Surfactant | 22.5 |
| Potassium Soap | 16.2 |
| Water | 4.5 |

In a most preferred embodiment, the wrinkle reducing agent is a linear aminopolydimethylsiloxane polyalkyleneoxide copolymer or sulfated castor oil. In addition, perfume is preferably added in a range from about 1 wt % to about 4 wt %, wherein about 2.5 wt % is most preferred. The fabric sheet formulation is applied to the substrate and packaged for use.

All component percentages are based on weight, unless otherwise indicated. All numerical values are considered to be modified by the term "about" and should be given the broadest available range of equivalents when construing the claims.

What is claimed is:

1. A liquid fabric softening formulation comprising from about 8 wt % to about 80 wt % of cationic fabric conditioning agents and from about 0.3 wt % to about 0.5 wt % of one or more wrinkle reducing agents selected from the group consisting of ethoxylated organosilicones; polyalkyleneoxide modified polydimethylsiloxane; linear aminopolydimethylsiloxane polyalkyleneoxide copolymers; sulfated/sulfonated vegetable oils; polyacrylamides; betaine siloxane copolymers; and alkylactam siloxanecopolymers.

2. The formulation according to claim 1, wherein the wrinkle reducing agent is a linear aminopolydimethylsiloxane polyalkyleneoxide copolymer.

3. The formulation according to claim 1, wherein the wrinkle reducing agent is sulfated castor oil.

4. The formulation according to claim 1, wherein at least one of the wrinkle reducing agents is present in the formulation in an amount from about 0.5 wt % to about 3.0 wt % of the formulation.

5. A method of reducing the occurrence of wrinkles in laundered clothing comprising:

providing a liquid fabric softening formulation comprising from about 8 wt % to about 80 wt % of cationic fabric conditioning agents and from about 0.3 wt % to about 5.0 wt % of at least one wrinkle reducing agent selected from the group consisting of ethoxylated organosilicones; polyalkyleneoxide modified polydimethylsiloxane; linear aminopolydimethylsiloxane polyalkyleneoxide copolymers; sulfated/sulfonated vegetable oils; polyacrylamides; betaine siloxane copolymers; and alkylactam siloxane copolymers; contacting the formulation with clothing subsequent to a washing procedure; and allowing the clothing to dry; wherein the laundered clothing has fewer wrinkles present than clothing laundered and dried in an identical manner with a liquid softening formulation that excludes the at least one wrinkle reducing agent.

* * * * *

UNITED STATES PATENT AND TRADEMARK OFFICE

CERTIFICATE OF CORRECTION

PATENT NO. : 6,376,456 B1 
DATED : April 23, 2002
INVENTOR(S) : Dennis Stephen Murphy, Daniel Joseph Fox and Francoise Meyer It is certified that error appears in the above-identified patent and that said Letters Patent is hereby corrected as shown below:

Column 6,
Line 4, "0.5 wt %" should read -- 5.0 wt % --

Signed and Sealed this

Tenth Day of September, 2002

*Attest:*

*Attesting Officer*

JAMES E. ROGAN
*Director of the United States Patent and Trademark Office*